US011096007B2

(12) United States Patent
Kleinhans et al.

(10) Patent No.: US 11,096,007 B2
(45) Date of Patent: Aug. 17, 2021

(54) METHOD FOR PROCESSING A MULTICHANNEL AUDIO SIGNAL

(71) Applicant: Faurecia Clarion Electronics Europe, Paris (FR)

(72) Inventors: Grégory Olivier Kleinhans, Paris (FR); Nicolas Lopez Zuleta, Montreuil (FR)

(73) Assignee: FAURECIA CLARION ELECTRONICS EUROPE, Paris (FR)

( * ) Notice: Subject to any disclaimer, the term of this patent is extended or adjusted under 35 U.S.C. 154(b) by 0 days.

(21) Appl. No.: 16/735,308

(22) Filed: Jan. 6, 2020

(65) Prior Publication Data

US 2020/0221246 A1 Jul. 9, 2020

(30) Foreign Application Priority Data

Jan. 4, 2019 (FR) ..... FR 19 00096

(51) Int. Cl.
*H04S 7/00* (2006.01)
*H04R 5/02* (2006.01)
*H04S 3/00* (2006.01)

(52) U.S. Cl.
CPC ..... *H04S 7/303* (2013.01); *H04R 5/02* (2013.01); *H04S 3/008* (2013.01); *H04S 2400/01* (2013.01); *H04S 2400/05* (2013.01)

(58) Field of Classification Search
CPC ..... H04S 7/303; H04S 3/008; H04S 2400/01; H04S 2400/05; H04R 5/02
See application file for complete search history.

(56) References Cited

U.S. PATENT DOCUMENTS 6,424,719 B1 * 7/2002 Elko ..... H04S 1/00 381/1
2002/0071574 A1 * 6/2002 Aylward ..... H04S 5/00 381/97
2003/0031332 A1 2/2003 Tatsuta et al.
2010/0303246 A1 12/2010 Walsh et al.
2019/0104362 A1 * 4/2019 Nakagawa ..... H04R 1/403

FOREIGN PATENT DOCUMENTS

JP 5781430 B2 9/2015

OTHER PUBLICATIONS

French Search report corresponding to French application No. FR 1900096, dated Nov. 13, 2019, 2 pages.
Written Opinion corresponding to French application No. FR 1900096, dated Nov. 13, 2019, 5 pages.

* cited by examiner

*Primary Examiner* — Andrew L Sniezek
(74) *Attorney, Agent, or Firm* — Reising Ethington P.C.

(57) ABSTRACT

A method for processing a multichannel audio signal includes: obtaining at least one group of signals associated with a pair of channels comprising a left side signal, a left central signal, a right central signal and a right side signal determined from the left input signal and the right input signal; and performing differentiated sound stage filtering for the central signals on the one hand, and the side signals of each group of signals on the other hand, the differentiated sound stage filtering including the application, for each group of signals, of the central sound stage filter to the left central signal and to the right central signal of the group of signals.

21 Claims, 3 Drawing Sheets

$L_{in}$
$R_{in}$
$S_M$
18
$H_c$
$H_c$
$H_s$
$H_s$
$L_c$
$R_c$
$L_s$
$R_s$
20
22
14
12
16
$FL_c$
$FR_c$
$FL_s$
$FR_s$
$RL_s$
$RR_s$
$RL_c$
$RR_c$
$HMAG_{FLC}$
$HMAG_{FRC}$
$HMAG_{FLS}$
$HMAG_{FRS}$
$HMAG_{RLS}$
$HMAG_{RRS}$
$HMAG_{RLC}$
$HMAG_{RRC}$
26
$FSSF_c$
$LSSF_s$
$RSSF_s$
$RSSF_c$
24
$G_{FLC}$
$G_{FRC}$
$G_{RLC}$
$G_{RRC}$
$FL_{OUT}$
$FR_{OUT}$
$RL_{OUT}$
$RR_{OUT}$

METHOD FOR PROCESSING A MULTICHANNEL AUDIO SIGNAL

TECHNICAL FIELD

The present invention relates to the field of reproducing sounds from an audio signal, that is to say, an electrical or digital signal representing sounds, and in particular a method for processing a multichannel audio signal for diffusion thereof by electroacoustic transducers capable of generating sounds from electrical signals.

BACKGROUND

A sound reproduction system can use several paths or channels to reproduce sounds with a spatialization effect from a multichannel audio signal, that is to say, a complex audio signal comprising several elementary audio signals, each path or channel comprising one or several electroacoustic transducer(s) and being dedicated to the diffusion of a respective audio signal from among the elementary audio signals.

A sound reproduction system with two channels (or "stereophonic system") comprises a right channel and a left channel.

A sound reproduction system with four channels (or "quadriphonic system") comprises a front left channel, a front right channel, a rear left channel and a rear right channel. Such a sound reproduction system with four channels can for example be installed in a motor vehicle.

The sound spatialization effect (or "spatial rendering") therefore makes it possible to give the listener the impression that different sounds reproduced by the sound reproduction system are coming from different emission points, in particular including emission points distinct of the electroacoustic transducers.

During the reproduction of a music recording played by a group of instruments, the spatialization of the sound produced by a stereophonic system allows the listener to have the impression of hearing the sounds of each instrument as coming from a determined respective position, corresponding to the position of the instruments during the recording.

In a sound reproduction system using channels associated by pairs of channels each comprising a left channel and a right channel, for example a stereophonic system or a quadriphonic system, the spatialization effect of the sound works correctly when a listener is located at equal distances from the electroacoustic transducers of each pair of channels.

However, in practice, the listener is rarely positioned exactly equidistantly from the electroacoustic transducers of the two channels of each pair of channels. This is for example the case in motor vehicles, in which the electroacoustic transducers of each pair of channels are generally arranged on the left and right of the vehicle substantially symmetrically relative to a median longitudinal plane of the vehicle, the passengers, in particular the front driver and the front passenger, nevertheless each being offset relative to this median longitudinal plane of the vehicle.

As a result, the sounds generated by the electroacoustic transducers of each pair of channels reach each listener off-centered relative to the median longitudinal plane with a phase capable of affecting the perception of the sounds by the listener, and in particular the spatialization effect.

SUMMARY

One of the aims of the invention is to propose a method for processing a multichannel audio signal allowing a satisfactory spatialization effect.

To that end, the invention proposes a method for processing a multichannel audio signal comprising at least one pair of input signals comprising a right input signal and a left input signal for reproducing sounds via at least one pair of channels comprising a right channel and a left channel, the processing method comprising:

- obtaining, from said input signals, at least one group of signals, each group of signals being associated with a pair of channels, each group of signals comprising a left side signal, a left central signal, a right central signal and a right side signal determined from the left input signal and the right input signal; and
- performing differentiated sound stage filtering for the central signals on the one hand, and the side signals of each group of signals on the other hand, the differentiated sound stage filtering comprising the application, for each group of signals, of a central sound stage filter to the left central signal and to the right central signal of said group of signals.

Obtaining, from a right input signal and a left input signal intended for the channels of a same pair of channels, side signals and central signals, and applying a differentiated sound stage filtering for the central signals and the side signals of this group of signals makes it possible to improve the spatialization effect.

This differentiated sound stage filtering in particular makes it possible to improve the perception of the spatial positioning of the sound sources, to control the listening angle of a stereophonic signal and to homogenize the spectral rendering of the central and side signals.

It further makes it possible to control the correlated components and the decorrelated components of a multichannel audio signal separately. The correlated components being able to introduce rendering problems into a multichannel system (resonance, coloring of the signal, etc.), it is beneficial to apply a specific processing to them to ensure a satisfactory rendering.

According to specific embodiments, the processing method comprises one or more of the following optional features, considered individually or according to any technically possible combination(s):

- at least two groups of signals are obtained at the end of the obtaining step, and the application of a sound stage filtering comprises applying a left side sound stage filter to the left side signals of said two groups of signals, and/or applying a right side sound stage filter to the right side signals of said two groups of signals;
- the processing method comprises, for each group of signals, after the sound stage filtering, the reconstruction of a left output signal from the left central signal and the left side signal of said group of signals and the reconstruction of a right output signal from the right central signal and the right side signal of said group of signals;
- the left output signal is obtained by linear combination of the left side signal and the left central signal after sound stage filtering, and the right output signal is obtained by the linear combination of the right side signal and the right central signal after the sound stage filtering;
- the obtainment of each group of signals from a pair of corresponding input signals comprises, on the one hand, the decomposition of the left input signal into a left channel central component and a left channel side component, and on the other hand, the decomposition of the right input signal into a right channel central component and a right channel side component;

the obtainment of each group of signals comprises estimating a central component extraction filter from the left input signal and the right input signal, using an extraction filter estimator and the application of the central component extraction filter to the left input signal in order to determine the left channel central component and to the right input signal in order to determine the right channel central component;

the obtainment of each group of signals comprises estimating a side component extraction filter from the left input signal and the right input signal, using an extraction filter estimator and the application of the side component extraction filter to the left input signal in order to determine the left channel side component and to the right input signal in order to determine the right channel side component; and the step for obtaining at least one group of signals comprises, for at least one group of signals, determining the left side signal, the left central signal, the right central signal and the right side signal by linear combination of the components of the input signals associated with this pair of channels, respectively according to the following formulas:

$$(1-G1)\times LS+G0\times LC$$

$$(1-G0)\times LC+G1\times LS+G1\times RS$$

$$(1-G0)\times RC+G1\times LS+G1\times RS$$

$$(1-G1)\times RS+G0\times RC$$

where G0 and G1 are predetermined constants between 0 and 1.

The invention also relates to a processing assembly of the signal for the processing of a multichannel audio signal, configured to implement a processing method as defined above.

The invention further relates to a sound reproduction system comprising a processing assembly of the signal as defined above and sound diffusion channels, each channel comprising at least one electroacoustic transducer.

BRIEF DESCRIPTION OF THE DRAWINGS

The invention and its advantages will be better understood upon reading the following description, provided solely as a non-limiting example, and done in reference to the appended drawings, in which.

DETAILED DESCRIPTION

Figure 1:
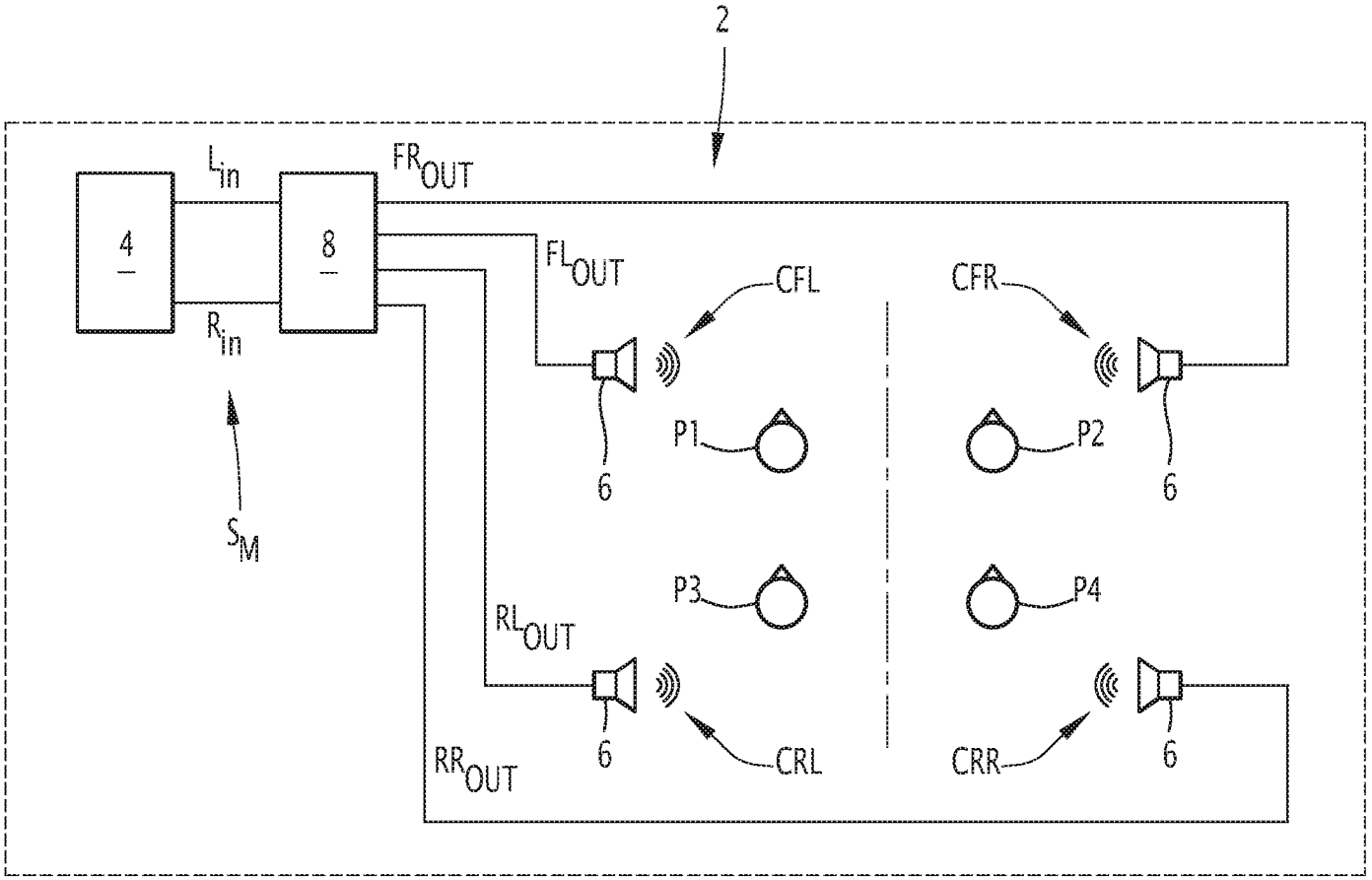
FIG. 1 is a schematic view of a multichannel sound reproduction system.

The sound reproduction system 2 shown in FIG. 1 is a multichannel sound reproduction system configured to diffuse a multichannel audio signal SM supplied by an audio signal source 4.

The sound reproduction system 2 comprising several channels $C_{FL}$, $C_{FR}$, $C_{RL}$, $C_{RR}$ associated by pair(s), each pair of channels comprising a left channel and a right channel.

The sound reproduction channel can comprise a single pair of channels (a stereophonic system) or several pairs of channels.

In the example illustrated in FIG. 1, the sound reproduction system 2 is a sound reproduction system with four channels associated by pairs, namely a pair of front channels comprising a front left channel $C_{FL}$ and a front right channel $C_{FR}$, and a pair of rear channels comprising a rear left channel $C_{RL}$ and a rear right channel $C_{RR}$.

Each channel $C_{FL}$, $C_{FR}$, $C_{RL}$, $C_{RR}$ of the sound reproduction system 2 comprises at least one electroacoustic transducer 6. Each electroacoustic transducer 6 is configured to convert an electrical output signal $FL_{OUT}$, $FR_{OUT}$, $RL_{OUT}$, $RR_{OUT}$ of the associated channel $C_{FL}$, $C_{FR}$, $C_{RL}$, $C_{RR}$ into a corresponding sound.

The electroacoustic transducers 6 are for example speakers.

In the exemplary embodiment illustrated in FIG. 1, each channel $C_{FL}$, $C_{FR}$, $C_{RL}$, $C_{RR}$ comprises a single electroacoustic transducer 6. In a variant, at least one channel, and in particular each channel, comprises several acoustic transducers.

The sound reproduction system 2 comprises a signal processing assembly 8 configured to receive a multichannel audio signal SM made up of a plurality of input signals $L_{IN}$, $R_{IN}$, in order to process each input signal $L_{IN}$, $R_{IN}$ so as to obtain corresponding output signals $FL_{OUT}$, $FR_{OUT}$, $RL_{OUT}$, $RR_{OUT}$, a respective output signal $FL_{OUT}$, $FR_{OUT}$, $RL_{OUT}$, $RR_{OUT}$ being associated with each channel $C_{FL}$, $C_{FR}$, $C_{RL}$, $C_{RR}$ of the sound reproduction system 2, and to supply said output signal $FL_{OUT}$, $FR_{OUT}$, $RL_{OUT}$, $RR_{OUT}$ to each electroacoustic transducer 6 of said corresponding channel $C_{FL}$, $C_{FR}$, $C_{RL}$, $C_{RR}$ for the conversion of said output signal $FL_{OUT}$, $FR_{OUT}$, $RL_{OUT}$, $RR_{OUT}$ into a sound by said electroacoustic transducer 6.

The signal processing assembly 8 is configured to implement a signal processing method applied to the multichannel audio signal SM so as to obtain the output signals $FL_{OUT}$, $FR_{OUT}$, $RL_{OUT}$, $RR_{OUT}$.

In one exemplary embodiment, the sound reproduction system 2 is configured to diffuse a multichannel audio signal SM with two input signals $L_{IN}$, $R_{IN}$ (that is to say, a stereophonic audio signal), namely a left input signal $L_{IN}$ and a right input signal $R_{IN}$, on several pairs of channels, the processing method of the signal comprising the determination of a respective output signal associated with each channel $C_{FL}$, $C_{FR}$, $C_{RL}$, $C_{RR}$ from two input signals $L_{IN}$, $R_{IN}$.

In the exemplary embodiment illustrated in FIG. 1, the sound reproduction system 2 is configured to diffuse a multichannel audio signal SM formed by two input signals $L_{IN}$, $R_{IN}$ on two pairs of channels, the processing method being configured to determine their respective output signal $FL_{OUT}$, $FR_{OUT}$, $RL_{OUT}$, $RR_{OUT}$ to be diffused by each channel $C_{FL}$, $C_{FR}$, $C_{RL}$, $C_{RR}$ from the multichannel audio signal SM with two input signals shared by said pairs of channels.

The multichannel audio signal SM therefore comprises a left input signal $L_{IN}$ and a right input signal $R_{IN}$, the signal processing method comprising the determination of a front left output channel signal $FL_{OUT}$, a front right output channel signal $FR_{OUT}$, a rear left output channel signal $RL_{OUT}$, and a rear right output channel signal $RR_{OUT}$.

The signal processing method comprises the obtainment, for at least one pair of channels comprising a right channel and a left channel, of a group of signals comprising a left side signal and a left central signal, and a right central signal and a right side signal.

In one exemplary embodiment, the signal processing method comprises, for at least one pair of channels and in particular for each pair of channels, determining a group of signals associated with said pair of channels from a left input signal $L_{IN}$ and a right input signal $R_{IN}$ that are associated with the right channel and the left channel of said pair of channels.

This determining step for example comprises the decomposition of the left input signal $L_{IN}$ into a left channel central component $L_C$ and a left channel side component $L_S$ and the decomposition of the right input signal $R_{IN}$ into a right channel central component $R_C$ and a right channel side component $R_S$ from the right channel input signal $R_{IN}$, and the determination of the left side signal, the left central signal, the right central signal and the right side signal from said components (left channel side component, left channel central component, right channel central component and right channel side component).

In order to determine the central components and the side components, it is possible to compute a measurement of the correlation level between the left input signal and the right input signal, and to determine the central components as being the portions of the input signals that have a correlation measurement above a predetermined correlation threshold (these are also called correlated components), and to determine the side components as being the portions of the input signals that have a correlation measurement below the predetermined correlation threshold (these are also called decorrelated components).

The left channel central component $L_C$ and the right channel central component $R_C$ are the correlated components of the left input signal $L_{IN}$ and the right input signal $R_{IN}$, that is to say, the parts of each of the input signals $L_{IN}$, $R_{IN}$ that have a correlation measurement between the two input signals $L_{IN}$, $R_{IN}$ above the predetermined correlation threshold.

The left channel side component $L_S$ and the right channel side component $R_S$ include the decorrelated components of the left input signal $L_{IN}$ and the right input signal $R_{IN}$, that is to say, the parts of each of the input signals $L_{IN}$, $R_{IN}$ that have a correlation measurement between the two input signals $L_{IN}$, $R_{IN}$ below the predetermined correlation threshold.

The premixing module 12 comprises a decomposition module 14 for decomposing the input signals $L_{IN}$, $R_{IN}$ so as to obtain the components $L_S$, $L_C$, $R_C$, $R_S$, and a mixing module 16 for determining the signals of each signal group from the components $L_S$, $L_C$, $R_C$, $R_S$.

The decomposition of each input signal $L_{IN}$, $R_{IN}$ for example comprises the estimate of a central component extraction filter $H_C$ from the left input signal $L_{IN}$ and the right input signal $R_{IN}$, and the extraction of the central components of the input signals $L_{IN}$, $R_{IN}$ by using the central component extraction filter $H_C$.

The central component extraction filter $H_C$ is determined so as to provide the central component of the input signal to which the central component extraction filter $H_C$ is applied.

The decomposition module 14 for example has an extraction filter estimator 18 configured to receive, as input, two associated input signals $L_{IN}$, $R_{IN}$ and to supply, as output, a central component extraction filter $H_C$.

The left channel central component $L_C$ is determined by applying the central component extraction filter $H_C$ to the left input signal $L_{IN}$ and the right channel central component $R_C$ is determined by applying the central component extraction filter $H_C$ to the right input signal $R_{IN}$.

In one exemplary embodiment, the decomposition of each input signal $L_{IN}$, $R_{IN}$ for example comprises the estimate of a side component extraction filter $H_S$ from the left input signal $L_{IN}$ and the right input signal $R_{IN}$, and the extraction of the side components of the input signals $L_{IN}$, $R_{IN}$ by using the side component extraction filter $H_S$.

The left channel side component $L_S$ is determined by applying the side component extraction filter $H_S$ to the left input signal $L_{IN}$ and the right channel side component $R_S$ is determined by applying the side component extraction filter $H_S$ to the right input signal $R_{IN}$.

The extraction filter estimator 18 is for example configured to determine the side component extraction filter $H_S$.

The central component extraction filter $H_C$ and the side component extraction filter $H_S$ are for example estimated according to the method taught in the article "*Frequency Domain techniques for stereo to multichannel upmix*", AES 22$^{nd}$ International Conference on Virtual, Synthetic and Entertainment Audio, Avendano, C., & Jot, J. (2002).

The decomposition module 14 comprises filters 20, 22 configured respectively to apply the central component extraction filter $H_C$ and the side component extraction filter $H_S$.

In one exemplary embodiment, each side component is determined as the difference between the corresponding input signal and the corresponding central component.

In such an exemplary embodiment, the left side component $L_S$ is determined as the difference between the left input signal $L_{IN}$ and the left central component $L_C$, and the right side component $R_S$ is determined as the difference between the right input signal $R_{IN}$ and the right central component $R_C$. The central component extraction filter $H_C$ and the side component extraction filter $H_S$ are linked by the relationship $H_S=1-H_C$.

The mixing module 16 is configured to determine the left side signal, the left central signal, the right central signal and the right side signal of each group of signals from the components (left channel side component, left channel central component, right channel central component and right channel side component) of the two input signals $L_{IN}$, $R_{IN}$ of the multichannel audio signal SM associated with this group of signals.

In one exemplary embodiment, for at least one group of signals and in particular for each group of signals, the left side signal is determined as being equal to the left channel side component $L_S$ of the left input signal $L_{IN}$, the left central signal is determined as being equal to the left channel central component $L_C$ of the left input signal $L_{IN}$, the right central channel is determined as being equal to the right channel central component $R_C$ of the right input signal $R_{IN}$ and the right side signal is determined as being equal to the right channel side component $R_S$ of the right input signal $R_{IN}$.

When the sound reproduction system 2 has a number of channels greater than that of the multichannel audio signal SM, in one exemplary embodiment, at least two groups of signals are associated with the same pair of left and right input signals $L_{IN}$, $R_{IN}$ and are determined identically from these left and right input signals $L_{IN}$, $R_{IN}$.

In the exemplary embodiment illustrated in FIG. 2, the two groups of signals are determined from two left and right input signals $L_{IN}$, $R_{IN}$ as follows: the front left side signal $FL_S$ and the rear left side signal $RL_S$ are determined as being equal to the left channel side component $L_S$; the front left central signal $FL_C$ and the rear left central signal $RL_C$ are determined as being equal to the left channel central component $L_C$; the front right central signal $FR_C$ and the rear right central signal $RR_C$ are determined as equal to the right channel central component $R_C$; and the front right side signal $FR_S$ and the rear right side signal $RR_S$ are determined as equal to the right channel side component $R_S$.

In another exemplary embodiment, for at least one group of signals, the signal processing assembly 8 receives the left central signal, the left side signal, the right central signal and the right side signal of each group of signals that are supplied for example by the audio source 4 supplying the multichannel input signal. The obtainment of these signals by the signal processing assembly 8 then simply consists of receiving these signals. The audio source 4 can supply these signals from a multichannel audio source natively including these signals or by itself applying the step for decomposition of the input signals and mixing of each group of signals.

The processing method comprises the application of a sound stage filtering comprising the application of a central sound stage filter to the left central signal and to the right central signal of each group of signals.

The central sound stage filter is not necessarily applied to the left side signal and to the right side signal of said group of signals.

A sound stage filtering is the application of a sound stage filter (or "phase filter") to a pair of signals, the phase filter applying a relative phase shift between said two signals, the relative phase shift preferably depending on the frequency.

Thus, the performance of a sound stage filtering comprising the application of a central sound stage filter to the left central signal and to the right central signal of said group of signals makes it possible to induce a relative phase shift between the left central signal and the right central signal of said group of signals, without necessarily introducing the same relative phase shift between the left side signal and the right side signal of said group of signals.

The application of a sound stage filter to a signal suitable for a right channel and a signal suitable for a left channel of the sound reproduction system 2 makes it possible to modify the perception of the sound stage along the right-left direction.

The sound stage filter applied to perform the sound stage filtering is for example determined as a function of a desired spatialization effect or of the environment in which the sounds are diffused, for example the passenger compartment of a motor vehicle.

The sound stage filter is for example determined to compensate or attenuate the phase shifts induced in one or several listening position(s) P1, P2, P3, P4 offset relative to the centered listening position with respect to the electroacoustic transducers 6 of the sound reproduction system 2.

According to the invention, a central sound stage filter is applied to the two central signals of a group of signals in order to modify the perception of the sound image along the right-left direction, the sound stage filtering being differentiated between the central signals on the one hand, and the side signals on the other hand.

The signal processing assembly 8 comprises a sound stage filtering module 24 configured to perform the sound stage filtering.

In one exemplary embodiment, the processing method comprises the application of a central sound stage filter $FSSF_C$, $RSSF_C$ to the left central signal and to the right central signal of at least one group of signals, and in particular of each group of signals, without applying a sound stage filter to the left side signal and to the right side signal.

The sound stage filtering module 24 then comprises a central sound stage filter $FSSF_C$, $RSSF_C$ that is configured to filter the central signals of said group of signals, and is devoid of a sound stage filter to filter the side signals of the group of signals.

Advantageously, the signal processing method comprises the application of a central sound stage filter $FSSF_C$, $RSSF_C$ to the left central signal and to the right central signal of each of the two groups of signals.

Figure 2:
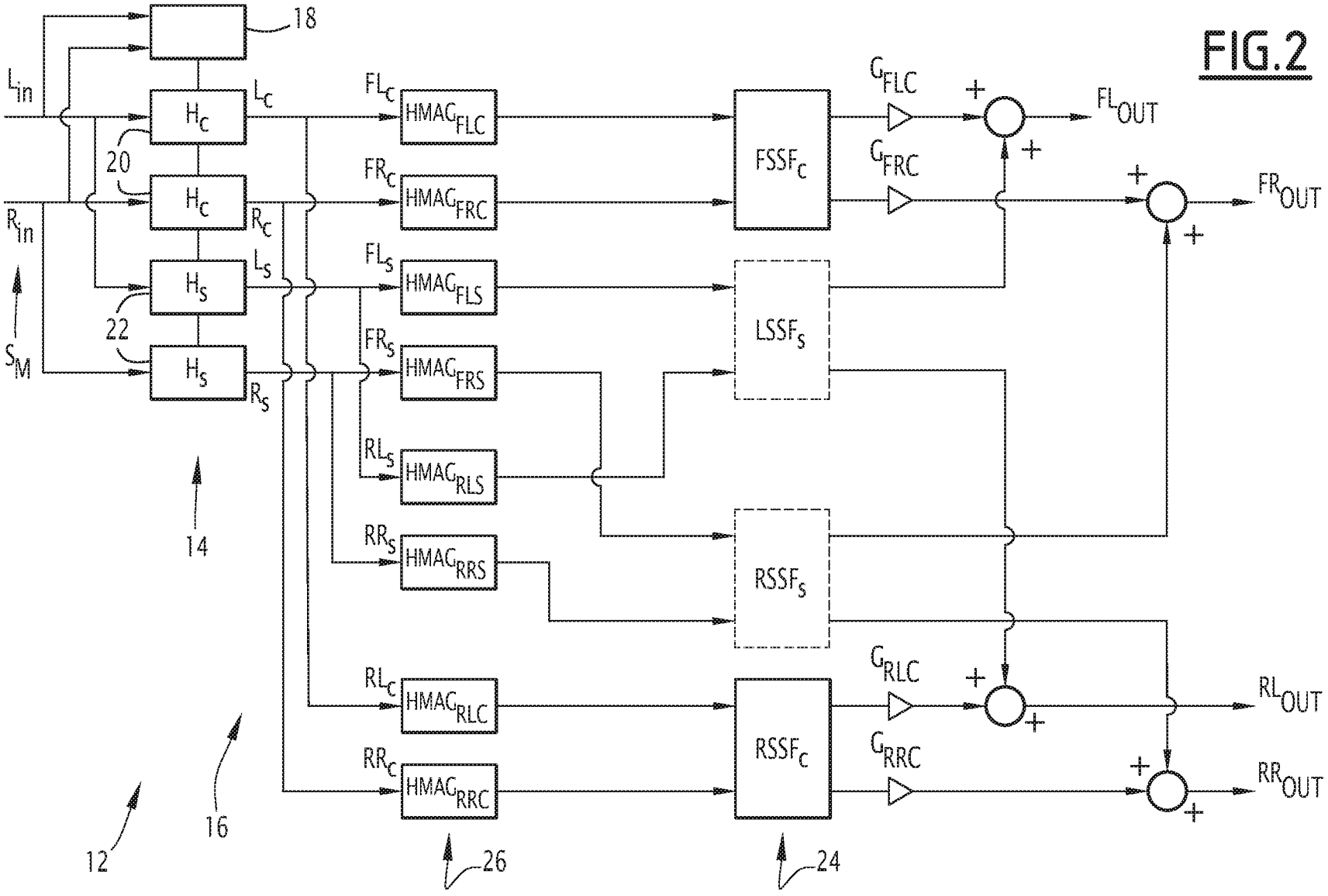
FIG. 2 is a block diagram illustrating a signal processing assembly of the sound reproduction system, configured to implement a signal processing method.

In the exemplary embodiment illustrated in FIG. 2, the sound stage filtering comprises the application of a front central sound stage filter $FSSF_C$ to the central signals $FL_C$, $FR_C$ of the group of front signals and the application of a rear central sound stage filter $RSSF_C$ to the central signals $RL_C$, $RR_C$ of the rear group of signals.

When several groups of signals are determined, the central sound stage filters used for central signals of distinct groups of signals can be different or identical.

In particular, when several groups of signals are identical, the application of different central sound stage filters $FSSF_C$, $RSSF_C$ to the central signals of these identical groups of signals makes it possible to obtain different output signals $FL_{OUT}$, $FR_{OUT}$, $RL_{OUT}$, $RR_{OUT}$ for the channels associated with these groups of signals.

In the exemplary embodiment illustrated in FIG. 2, the two groups of signals are identical, but the central sound stage filters $FSSF_C$, $RSSF_C$ applied to the central signals $FL_C$, $FR_C$, $RL_C$, $RR_C$ of these groups of signals are different.

The application of a sound stage filter to two side signals associated with two channels of two distinct pairs of channels diffusing the sound laterally on a same side, for example two right channels of two distinct pairs of channels or two left channels of two distinct pairs of channels, can make it possible to modify the perception of the sound image on the side of the sound stage, along the front-back direction.

Thus, optionally, and as illustrated in dotted lines in FIG. 2, when the signal processing method comprises determining at least two groups of signals each associated with a respective pair of channels, the signal processing method comprises, aside from the application of a central sound stage filter $FSSF_C$, $RSSF_C$ to the left central signal and to the right central signal of at least one of the two groups of signals, in particular of each of the two groups of signals, the application of a left sound stage filter $LSSF_S$ between the left side signals of the two groups of signals and/or the application of a right sound stage filter $RSSF_S$ between the right side signals of the two groups of signals.

Preferably, and like in the exemplary embodiment illustrated in FIG. 2, a left sound stage filter $LSSF_S$ is applied between the left side signals of the two groups of signals and a right sound stage filter $RSSF_S$ is applied between the right side signals of the two groups of signals.

Left and right sound stage filters respectively applied to left side signals and right side signals of two groups of signals can be different or identical depending on the reproduction of the desired sound image respectively on the left and right of the sound stage.

The sound stage filtering of the different signals of a same group of signals and/or different groups of signals can affect the amplitude of the frequency response of the processing assembly for one or several signals.

Optionally, the processing method comprises the amplitude filtering of each signal of each group of signals, so as to equalize the amplitude of the frequency response of the signals of said group of signals.

The amplitude equalization of the frequency response means that a same input amplitude yields a same output amplitude for all of the frequencies, for the different signals of each group of signals.

The signal processing assembly 8 comprises, in this case, one or several amplitude equalization filter(s), each amplitude equalization filter being configured to filter a signal of a group of signals.

When the method comprises determining several groups of signals, the amplitude equalization filters are configured for equalization of the amplitude of the frequency response between the different groups of signals.

In the illustrated example, the signal processing assembly comprises a respective amplitude equalization filter $HMAG_{FLC}$, $HMAG_{FRC}$, $HMAG_{FLS}$, $HMAG_{FRS}$, $HMAG_{RLC}$, $HMAG_{RRC}$, $HMAG_{RLS}$, $HMAG_{RRS}$, associated with each signal of each group of signals, for the filtering of this signal.

The signal processing method comprises, for each group of signals, the mixing of the side signal and the central signal that are associated with the same channel so as to obtain a channel output signal corresponding to said channel, and suitable for being sent to each electroacoustic transducer 6 of said channel for the diffusion of the corresponding sound.

The signal processing method thus comprises, for each group of signals, the mixing of the left central signal and the left side signal to obtain the left channel output signal associated with this group of signals, and the mixing of the right central signal and the right side signal to obtain the left channel output signal associated with this group of signals.

The mixing is preferably done, for each group of signals, as a linear combination of the side signal and the central signal that are associated with a same channel, with specific respective coefficients for each channel and each group of signals.

In the example illustrated in FIG. 2, the mixing comprises the determination of the front left output signal $FL_{OUT}$ by linear combination of the front left central signal $FL_C$ and the front left side signal $FL_S$, the determination of the front right output signal $FR_{OUT}$ by linear combination of the front right central signal $FR_C$ and the front right side signal $FR_S$, the determination of the rear right output signal $RR_{OUT}$ by linear combination of the rear right central signal $RR_C$ and the rear right side signal $RR_S$, and the determination of the rear left output signal $RL_{OUT}$ by linear combination of the rear left central signal $RL_C$ and the rear left side signal $RL_S$.

In the illustrated exemplary embodiment, for each channel, the combination is done by adding the central signal $FL_C$, $FR_C$, $RL_C$, $RR_C$ associated with this channel affected by a first specific coefficient $G_{FLC}$, $G_{FRC}$, $G_{RLC}$, $G_{RRC}$, and the side signal $FL_S$, $FR_S$, $RL_S$, $RR_S$ associated with said channel affected by a second coefficient equal to 1.

In the exemplary embodiment illustrated in FIG. 2, for each group of signals, the left central signal is determined as being equal to the left channel central component, the left side signal is determined as being equal to the left channel side component, the right central signal is determined as being equal to the right channel central component and the right side signal is determined as being equal to the right channel side component.

It is possible to perform a different premixing to obtain different effects in the reproduction of the sounds. Furthermore, it is possible to perform different premixing operations for different groups of signals.

Thus, according to one premixing operation, the left side signal, the left central signal, the right central signal and the right side signal of at least one group of signals associated with a pair of channels are determined by linear combination of the components $L_S$, $L_C$, $R_C$, $R_S$ of the input signal associated with this pair of channels, respectively, according to the following formulas:

$$(1-G_1)\times L_S+G_0\times L_C$$

$$(1-G_0)\times L_C+G_1\times L_S+G_1\times R_S$$

$$(1-G_0)\times R_C+G_1\times L_S+G_1\times R_S$$

$$(1-G_1)\times R_S+G_0\times R_C$$

where $G_0$ and $G_1$ are predetermined constants between 0 and 1.

Such a premixing operation allows fine control of the sound stage filtering on "two dimensions", that is to say, from right to left and from front to back. It for example makes it possible to control the width and the apparent angle of the sound stage perceived by the listener through a mix of the sound image located facing the listener with the sound image located on the side of the listener.

Advantageously, in one exemplary embodiment, the same premixing operation is applied to at least two groups of signals, in particular to each group of signals.

Figure 3:
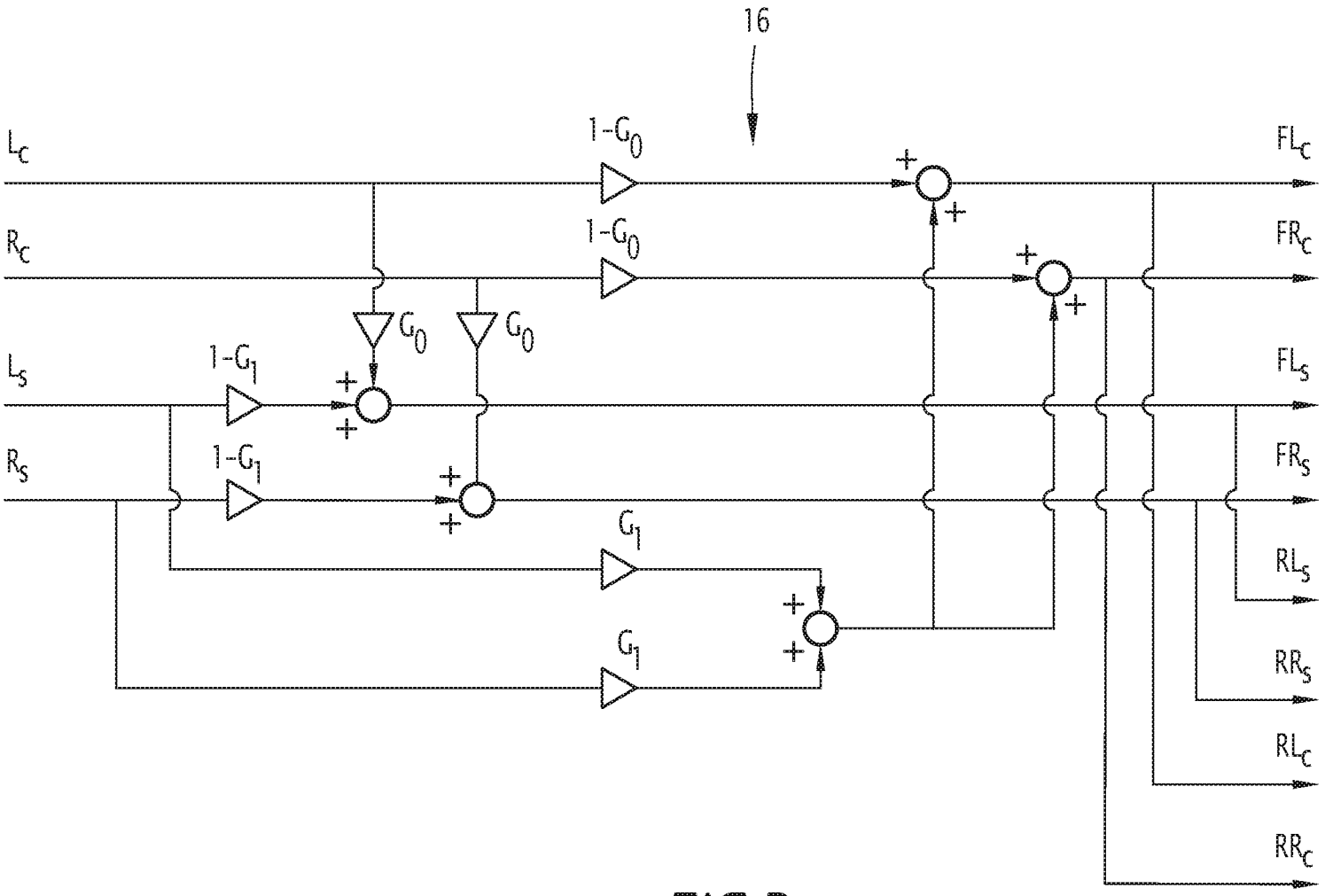
FIG. 3 is a block diagram illustrating an alternative exemplary embodiment of a premixing module of the signal processing assembly.

In the exemplary embodiment illustrated in FIG. 3, the signals of the two groups of signals $FL_C$, $FR_C$, $FL_S$, $FR_S$ and $RL_C$, $RR_C$, $RL_S$, $RR_S$ are determined from components $L_S$, $L_C$, $R_C$, $R_S$ of the stereophonic audio signal according to the following formulas:

$$FL_S=RL_S=(1-G_1)\times L_S+G_0\times L_C$$

$$FL_C=RL_C=(1-G_0)\times L_C+G_1\times L_S+G_1\times R_S$$

$$FR_C=RR_C=(1-G_0)\times R_C+G1\times L_S+G1\times R_S$$

$$FR_S=RR_S=(1-G_1)\times R_S+G_0\times R_C$$

where $G_0$ and $G_1$ are predetermined constants between 0 and 1.

In one exemplary embodiment, each module of the signal processing assembly 8 is for example provided in the form of a software application comprising code instructions able to be recorded on a computer memory and executable by a processor.

Alternatively, at least one module of the signal processing assembly 8 is provided in the form of a specific integrated circuit (or ASIC, "Application-Specific Integrated Circuit") or a programmable logic circuit, for example a field programmable gate array (FPGA).

The invention is not limited to the example embodiments and variants described below, other exemplary embodiments and other variants being conceivable.

In the exemplary embodiments described above, all of the channels are associated by pairs, each channel being paired with another channel, each pair of channels comprising a left channel and a right channel.

Optionally, the sound reproduction system is further configured to reproduce an additional channel that is not paired with another channel. The additional channel is for example a bass channel configured to reproduce low-frequency sounds, via an acoustic transducer generally called "subwoofer".

The system is not limited to stereophonic or quadriphonic systems. The same method can be applied on systems with a number of pairs of channels greater than or equal to three (e.g., 3 or 4 pairs of channels).

Furthermore, the application of a side sound stage filter to right side signals and/or left side signals of two distinct groups of signals is conceivable independently of the application of a central sound stage filter to the central signals of one or each of said two groups of signals.

Thus, in a general manner, the invention also relates to a method for processing a multichannel audio signal comprising at least one pair of input signals, each pair of input signals comprising a right input signal and a left input signal for reproducing sounds via at least two pairs of channels, each pair of channels comprising a right channel and a left channel, the processing method comprising:

obtaining, from said input signals, a group of signals associated with each pair of channels, each group of signals comprising a left side signal and a left central signal determined from the left input signal of a pair of input signals, and a right central signal and a right side signal determined from the right input signal of said pair of input signals;

performing sound stage filtering, preferably differentiated, for the central signals on the one hand, and the side signals of each group of signals on the other hand, the sound stage filtering comprising the application of a left sound stage filter LSSFS between the left side signals of the two groups of signals to introduce a relative phase shift between these left side signals and/or the application of a right sound stage filter RSSFS between the right side signals of the two groups of signals to introduce a relative phase shift between these right side signals.

The invention claimed is:

1. A method for processing a multichannel audio signal comprising at least one pair of input signals comprising a right input signal and a left input signal for reproducing sounds via at least one pair of channels comprising a right channel and a left channel, the processing method comprising:

obtaining, from said input signals, at least one group of signals, each group of signals being associated with a pair of channels, each group of signals comprising a left side signal, a left central signal, a right central signal and a right side signal determined from the left input signal and the right input signal; and performing differentiated sound stage filtering for the central signals of each group of signals and for the side signals of each group of signals, the differentiated sound stage filtering comprising the application, for each group of signals, of a central sound stage filter to the left central signal and to the right central signal of said group of signals, wherein the central sound stage filter is a phase filter configured to apply a phase shift between the central signals, and wherein at least two groups of signals are obtained at the end of the obtaining step, and the sound stage filtering comprises applying a left side sound stage filter to the left side signals of said two groups of signals, and/or applying a right side sound stage filter to the right side signals of said two groups of signals.

2. The processing method according to claim 1, comprising, for each group of signals, after the sound stage filtering, the reconstruction of a left output signal from the left central signal and the left side signal of said group of signals and the reconstruction of a right output signal from the right central signal and the right side signal of said group of signals.

3. The processing method according to claim 2, wherein the left output signal is obtained by linear combination of the left side signal and the left central signal after sound stage filtering, and the right output signal is obtained by the linear combination of the right side signal and the right central signal after the sound stage filtering.

4. The processing method according to claim 1, wherein the obtaining of each group of signals from a pair of corresponding input signals comprises decomposition of the left input signal into a left channel central component and a left channel side component, and decomposition of the right input signal into a right channel central component and a right channel side component.

5. The processing method according to claim 4, wherein the obtaining of each group of signals comprises estimating a central component extraction filter from the left input signal and the right input signal, using an extraction filter estimator, and the application of the central component extraction filter to the left input signal in order to determine the left channel central component and to the right input signal in order to determine the right channel central component.

6. The processing method according to claim 4, wherein the obtaining of each group of signals comprises estimating a side component extraction filter from the left input signal and the right input signal, using an extraction filter estimator, and the application of the side component extraction filter to the left input signal in order to determine the left channel side component and to the right input signal in order to determine the right channel side component.

7. The processing method according to claim 4, wherein the step for obtaining at least one group of signals comprises, for at least one group of signals, determining the left side signal, the left central signal, the right central signal and the right side signal by linear combination of the components of the input signals associated with each pair of channels, respectively according to the following formulas:

$$(1-G_1)\times L_S+G_0\times L_C$$

$$(1-G_0)\times L_C+G_1\times L_S+G_1\times R_S$$

$$(1-G_0)\times R_C+G_1\times L_S+G_1\times R_S$$

$$(1-G_1)\times R_S+G_0\times R_C$$

where $G_0$ and $G_1$ are predetermined constants between 0 and 1, $L_S$ is the left channel side component, $L_C$ is the left channel central component, $R_C$ is the right channel central component, and $R_S$ is the right channel side component.

8. A signal processing assembly for the processing of a multichannel audio signal, comprising a processor configured to implement a processing method according to claim 1.

9. A sound reproduction system comprising the signal processing assembly of claim 8 and sound diffusion channels, each channel comprising at least one electroacoustic transducer.

10. A method for processing a multichannel audio signal comprising at least one pair of input signals comprising a right input signal and a left input signal for reproducing sounds via at least one pair of channels comprising a right channel and a left channel, the processing method comprising:

obtaining, from said input signals, at least one group of signals, each group of signals being associated with a pair of channels, each group of signals comprising a left side signal, a left central signal, a right central signal and a right side signal determined from the left input signal and the right input signal; and performing differentiated sound stage filtering for the central signals of each group of signals and for the side signals of each group of signals, the differentiated sound stage filtering comprising the application, for each group of signals, of a central sound stage filter to the left central signal and to the right central signal of said group of signals, wherein the central sound stage filter is a phase filter configured to apply a phase shift between the central signals, wherein the obtaining of each group of signals the corresponding input signals comprises decomposition of the left input signal into a left channel central component and a left channel side component, and decomposition of the right input signal into a right channel central component and a right channel side component, and wherein the obtaining of each group of signals comprises estimating a central component extraction filter from the left input signal and the right input signal, using an extraction filter estimator, and the application of the central component extraction filter to the left input signal in order to determine the left channel central component and to the right input signal in order to determine the right channel central component.

11. The processing method according to claim 10, comprising, for each group of signals, after the sound stage filtering, the reconstruction of a left output signal from the left central signal and the left side signal of said group of signals and the reconstruction of a right output signal from the right central signal and the right side signal of said group of signals.

12. The processing method according to claim 11, wherein the left output signal is obtained by linear combination of the left side signal and the left central signal after sound stage filtering, and the right output signal is obtained by the linear combination of the right side signal and the right central signal after the sound stage filtering.

13. The processing method according to claim 10, wherein the obtaining of each group of signals comprises estimating a side component extraction filter from the left input signal and the right input signal, using an extraction filter estimator, and the application of the side component extraction filter to the left input signal in order to determine the left channel side component and to the right input signal in order to determine the right channel side component.

14. A signal processing assembly for the processing of a multichannel audio signal, comprising a processor configured to implement a processing method according to claim 10.

15. A sound reproduction system comprising the signal processing assembly of claim 14 and sound diffusion channels, each channel comprising at least one electroacoustic transducer.

16. A method for processing a multichannel audio signal comprising at least one pair of input signals comprising a right input signal and a left input signal for reproducing sounds via at least one pair of channels comprising a right channel and a left channel, the processing method comprising:

obtaining, from said input signals, at least one group of signals, each group of signals being associated with a pair of channels, each group of signals comprising a left side signal, a left central signal, a right central signal and a right side signal determined from the left input signal and the right input signal; and performing differentiated sound stage filtering for the central signals of each group of signals and for the side signals of each group of signals, the differentiated sound stage filtering comprising the application, for each group of signals, of a central sound stage filter to the left central signal and to the right central signal of said group of signals, wherein the central sound stage filter is a phase filter configured to apply a phase shift between the central signals, wherein the obtaining of each group of signals the corresponding input signals comprises decomposition of the left input signal into a left channel central component and a left channel side component, and decomposition of the right input signal into a right channel central component and a right channel side component, and wherein the obtaining of each group of signals comprises estimating a side component extraction filter from the left input signal and the right input signal, using an extraction filter estimator, and the application of the side component extraction filter to the left input signal in order to determine the left channel side component and to the right input signal in order to determine the right channel side component.

17. The processing method according to claim 16, comprising, for each group of signals, after the sound stage filtering, the reconstruction of a left output signal from the left central signal and the left side signal of said group of signals and the reconstruction of a right output signal from the right central signal and the right side signal of said group of signals.

18. The processing method according to claim 17, wherein the left output signal is obtained by linear combination of the left side signal and the left central signal after sound stage filtering, and the right output signal is obtained by the linear combination of the right side signal and the right central signal after the sound stage filtering.

19. The processing method according to claim 16, wherein the obtaining of each group of signals comprises estimating a central component extraction filter from the left input signal and the right input signal, using an extraction filter estimator, and the application of the central component extraction filter to the left input signal in order to determine the left channel central component and to the right input signal in order to determine the right channel central component.

20. A signal processing assembly for the processing of a multichannel audio signal, comprising a processor configured to implement a processing method according to claim 16.

21. A sound reproduction system comprising the signal processing assembly of claim 20 and sound diffusion channels, each channel comprising at least one electroacoustic transducer.

* * * * *